United States Patent [19]

Osterrath

[11] Patent Number: 4,621,649

[45] Date of Patent: Nov. 11, 1986

[54] CIGARETTE PACKET WITH ELECTRIC LIGHTER

[76] Inventor: Hans Osterrath, D-5928 Laasphe 3, Fed. Rep. of Germany

[21] Appl. No.: 629,825

[22] PCT Filed: Oct. 10, 1983

[86] PCT No.: PCT/DE83/00171

§ 371 Date: Aug. 23, 1984

§ 102(e) Date: Aug. 23, 1984

[87] PCT Pub. No.: WO84/01695

PCT Pub. Date: May 10, 1984

[30] Foreign Application Priority Data

Oct. 28, 1982 [DE] Fed. Rep. of Germany ..... 3240015

[51] Int. Cl.[4] ..... A24F 15/18

[52] U.S. Cl. ..... 131/185; 131/329; 131/351; 206/147

[58] Field of Search ..... 131/329, 351, 185; 221/143, 147, 148; 206/86, 85; 219/5, 262, 267, 268, 270

[56] References Cited

U.S. PATENT DOCUMENTS

| | | | |
|---|---|---|---|
| 1,971,203 | 3/1933 | Soltys | 131/351 |
| 2,528,619 | 11/1950 | Stein . | |
| 2,803,376 | 8/1957 | Kampff | 131/351 |
| 2,997,045 | 8/1961 | Kampff | 131/351 |
| 3,047,192 | 7/1962 | Sykes | 221/143 |
| 3,369,104 | 2/1968 | Lovercheck | 131/351 |
| 3,548,148 | 12/1970 | Kawasima | 219/262 |
| 4,310,007 | 1/1982 | Auersbacher . | |
| 4,342,902 | 8/1982 | Ping . | |
| 4,491,139 | 1/1985 | Weinert | 131/351 |

*Primary Examiner*—V. Millin
*Assistant Examiner*—H. Macey
*Attorney, Agent, or Firm*—Bacon & Thomas

[57] ABSTRACT

The cigarette packet has an electric lighter for the cigarettes contained in the packet. The lighter is arranged at the closed end of the packet, which is positioned opposite the end from where the cigarettes are pulled out of the packet, and comprises an electric battery as well as two electrically conductive contacts which are connected to the +pole and the −pole of the battery respectively. Each of the cigarettes is provided at one end with a lighting part which can be brought into contact with the contacts and, as a result of the current which is then supplied by the battery, can be heated to a temperature which suffices to light the cigarette in question. So as to light the cigarettes when pulling them out of the packet, they are arranged in the packet in such a way that the ends provided with the lighting part face the closed end of the packet. Furthermore the one contact extends inside the packet away from the closed end of the packet to the end from where the cigarettes are pulled out of the packet, so that every cigarette, when pulled out of the packet, slides with the lighting part along this contact. The other contact extends inside the packet to the lighting part of each cigarette contained therein, and is connected to this lighting part in an electrically conductive manner until the cigarette has been pulled out of the packet by a certain distance.

31 Claims, 7 Drawing Figures

CIGARETTE PACKET WITH ELECTRIC LIGHTER

Figure 1:
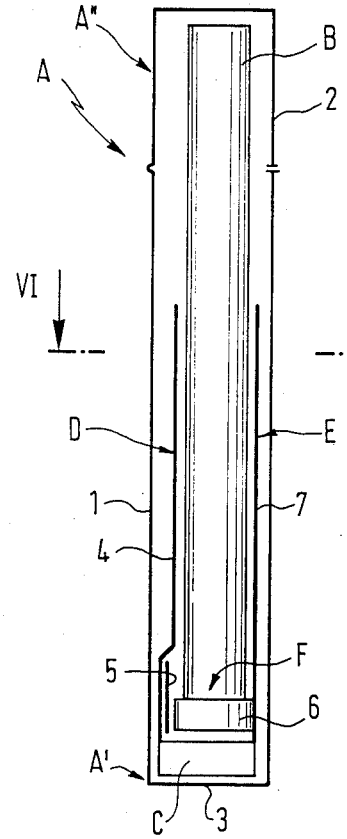

The invention relates to a cigarette packet with an electric lighter for the cigarettes contaned in the packet, of the type indicated in the introductory part of patent claim 1.

Such cigarette packets are known (U.S. Pat. No. 4,310,007). Here the lighter is provided in a separate compartment of the cigarette packet, so that the contacts extend in a plane parallel to a narrow side of the packet behind a circular opening in this narrow side of the packet. The cigarettes contained in the packet are lit in that a cigarette is pulled out of the packet and is then, with the end provided with the lighting part, put into the opening until it touches the contacts. The lighting part consists of an end layer of carbon fibres with a low electrical resistance followed by a layer of tobacco treated with potassium nitrate.

It is the aim of the invention to create a cigarette packet of this type which is improved in such a manner that the cigarettes contained therein are lit already when they are pulled out of the packet, as is known per sé, i.e. in the case of cigarette packet with a friction lighter (U.S. Pat. Nos. 2,803,376 and 2,997,045).

This aim is achieved by the features indicated in the characterizing part of patent claim 1. Advantageous embodiments of the cigarette packet according to the invention are specified in the other patent claims.

The invention offers the advantage that in order to light the cigarettes contained in the packet, it is not necessary after pulling them out of the packet to again push them into a separate lighter, and that during the lighting no gases occur which could have an adverse effect on the taste, which as a rule is the case with the known cigarette packets with friction lighter.

Figure 6:
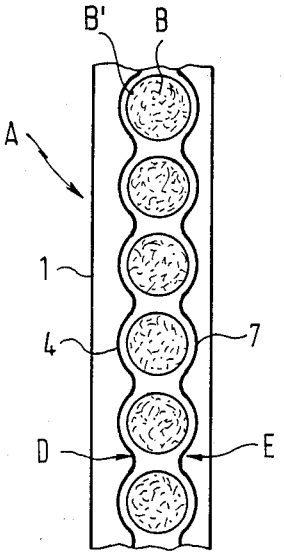
Figure 2:
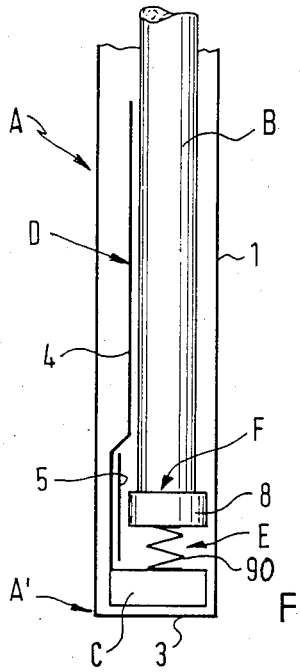
Figure 5:
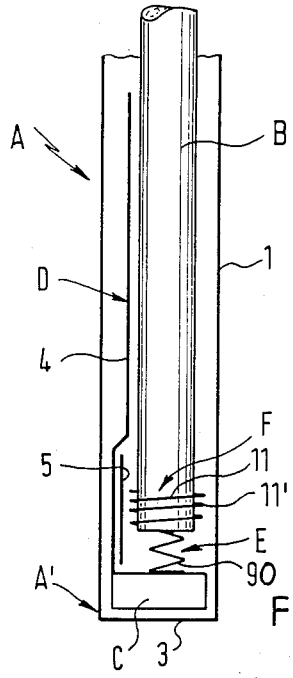
Figure 3:
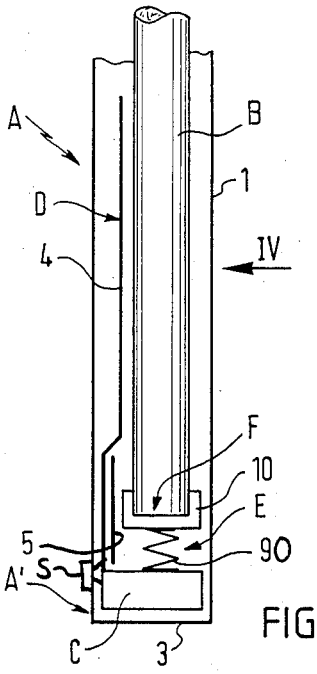
Figure 4:
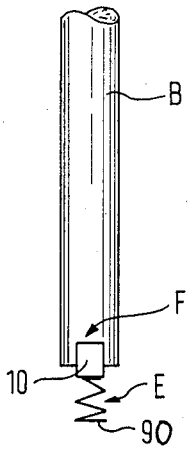

In the following four embodiments of the cigarette packet according to the invention are described by way of example with reference to the drawing. Shown therein, in each instance diagrammatically are:

FIG. 1 a section through a first embodiment parallel to the two narrow sides of the packet;

FIG. 2 the section according to FIG. 1 through a second embodiment, in the region of the bottom closed end of the packet;

FIGS. 3 and 4, both sections according to FIG. 2 through a third embodiment and the view of the cigarette according to FIG. 3 in the direction of arrow IV;

FIG. 5 the section according to FIG. 2 through a fourth embodiment;

FIG. 6 part of the cross-section along line VI—VI in FIG. 1; and

Figure 7:
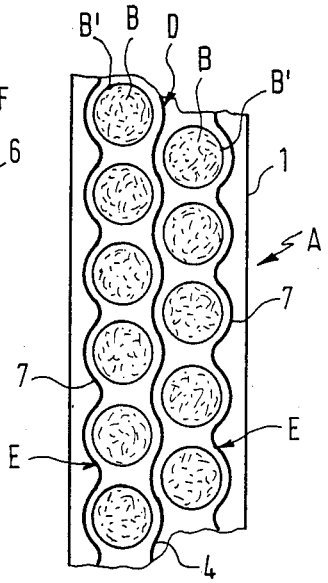

FIG. 7 the cross-section according to FIG. 6 through a cigarette packet with two rows of cigarettes.

The cigarette packet A contains according to FIGS. 1 to 6 one row or according to FIG. 7 two rows of cigarettes B. So as to light the cigarettes B when pulling them out of the packet A, a lighter with an electric battery C as well as two electrically conductive contacts D and E is provided, which contacts are connected to the + pole and the − pole of the battery C respectively. When pulling them out of the packet A the cigarettes B cooperate with the lighter by means of a lighting part F which is provided at the one end of each cigarette B and which, when the cigarette B is pulled out of the packet A, is heated by the current supplied by the battery C to a temperature which suffices for lighting the cigarette B.

The cigarette packet A has a bottom, closed end A′ and a top end A″ for pulling the cigarettes B out of the packet A. The housing 1 of the cigarette packet A can be opened at the packet end A″, and to this effect is provided, for example, with a tilt-up lid 2. The cigarettes B are arranged in the packet A in such a way that the ends provided with the lighting part F always face the closed end A′ of the packet.

The battery C is a flat battery which is arranged on the bottom 3 of the housing 1. The one contact D extends inside the housing 1 away from the battery C towards the lid 2 and is formed by a foil 4 of metal which covers the adjacent broad side of the housing 1 on the inside. The foil 4 is sealed off from the lighting parts F of the cigarettes B contained in the housing by an insulating foil 5, which extends near the bottom 3 between the two narrow sides of the housing 1.

The lighting parts F of the cigarettes B and the other contact E may be provided in different ways.

With the embodiment of FIG. 1 the lighting parts F are provided as an annular coating 6 of the individual cigarettes B, which coating contains a metal and/or graphite powder and becomes incandescent and may possibly burn when current is supplied thereto. The other contact E is provided similar to the first contact D and extends inside the housing 1, on the opposite side of the first contact D, away from the battery C towards the lid 2 of the housing 1. The other contact E is also made of a metal foil 7 which covers the inside of the adjacent broad side of the housing 1.

When a cigarette B is pulled out of the cigarette packet A of FIG. 1, it slides with its annular coating 6 along the metal foil 7. After pulling out the cigarette B by a certain height corresponding to the height of the insulating foil 5, the coating 6 comes in contact with the metal foil 4, and then slides along same. The circuit of the battery C is then closed, so that the annular coating 6 is heated and the cigarette B is lit. On leaving the cigarette packet A it can be smoked immediately.

With the embodiment of FIG. 2 the lighting parts F are provided as a thin metal ring 8, which surrounds the individual cigarettes B. The other contact E of the device for lighting the lighting parts F of the cigarettes B is formed by several metal springs 90, each of which is associated with a cigarette B and is at the two ends connected in an electrically conductive manner with the − pole of the battery C and the ring 8 of the cigarette B in question respectively. To produce the electrically conductive springs 90, suitable spring wire can be used.

The embodiment of FIGS. 3 and 4 essentially only differs from that of FIG. 2 in that the lighting parts F are provided as thin, U-shaped metal clasps 10, which are positioned axially on the associated cigarettes B, so that essentially they extend diametrically over the adjacent end of the cigarettes B, and are connected in an electrically conductive manner to the associated metal spring 90.

The embodiment of FIG. 5 essentially only differs from that of FIG. 2 in that the lighting parts F are each provided as a wire coil 11 which surrounds the associated cigarette B. The diameter of the wire coil 11 becomes larger in the direction away from the associated spring 90. The coil wire 11′ is made of metal and every wire coil forms an integral part of the associated metal spring 90, so that the latter forms part of the coil wire 11′.

When pulling a cigarette B out of the cigarette packet A according to FIGS. 2 and 3 respectively and 4 and 5 respectively, after leaving the insulating foil 5, it slides with its ring 8, or its clasp 10 or the upper turn with the largest diameter of its wire coil 11, along the metal foil 4, so that the circuit of the battery C is closed, and the ring 8 or the clasp 10 or the wire coil 11 is heated and the cigarette B is lit, which cigarette B can be smoked immediately on leaving the packet. When the cigarette B has been pulled out of the packet A by a certain distance, then the associated spring 90, which is stretched during the pulling out, pulls the ring 8 or the clasp 10 or the wire coil 11 of the cigarette B back again, so that the circuit of the battery C and the flow of current are again interrupted. This ensures that no glowing, solid particles can fall off the burning cigarette B which has been taken out of the packet A. Also the coating 6 of the cigarettes B provided with the embodiment of FIG. 1 is chosen in such a way that after lighting the tobacco content of the cigarette B in question, no glowing, solid particles can fall off, for example, in that the coating 6 in question is allowed to burn up after the tobacco content of the cigarette B in question has been lit.

According to FIG. 6 the two metal foils 4 and 7 which form the two contacts D and E of the lighter for the lighting parts F of the cigarettes B with the embodiment of FIG. 1, are both corrugated. This corrugation improves the electric contact with the lighting parts F as compared to a point contact between the contacts D and E on the one hand and the lighting parts F on the other hand, and furthermore ensures a reliable fixing in position of each individual cigarette B in the packet A. Also with the embodiments according to FIG. 2, or 3 and 4, or 5 the metal foil 4 is advantageously corrugated in the manner shown in FIG. 6.

Although FIGS. 1 to 6 shows cigarette packets A with only one row of cigarettes B, in each case also an embodiment with, for example, two rows of cigarettes B is possible. As illustrated in FIG. 7 for the embodiment according to FIG. 1, in that case the metal foil 4 is expediently arranged between the two rows of cigarettes B, and this centre foil 4 is then covered on both sides by an insulating foil 5.

Also further modifications of the illustrated and described embodiments are still possible. Thus, for example, further insulating foils can be arranged cross-wise to the insulating foil or insulating foils 5, so as to separate from one another the lighting parts F of the cigarettes B contained in the cigarette packet A, thus increasing the safety in respect of an unintentional lighting of adjacent cigarettes B when one cigarette B is pulled out of the cigarette packet A. To this effect it is also possible to provide the cigarette packet A with an additional switch S, as shown in FIG. 3 which can be actuated when one takes hold of the cigarette packet A in order to pull out a cigarette B, to then only allow the closing of the circuit of the battery C when the cigarette B in question is pulled out of the packet A.

Finally the cigarette packet A can also be provided as a re-usable packet which can in each instance be filled with cigarettes B. For the re-filling a re-fill pack with the cigarettes B provided with the lighting parts F and the contacts D as well as E of the lighter may, for example, be put into the re-usable packet, and in doing so the contacts are then automatically connected to the battery C provided in the re-usable packet.

To facilitate and improve the putting-on and the holding in position of the lighting parts F on the cigarettes B, it is possible to thicken and/or to reinforce the cigarette paper or the sheath B' of the cigarette B in the region of the coating 6, or of the ring 8, or of the clasp 10, or of the wire coil 11 of the cigarette B.

The packet A can be used not only for cigarettes B, but may for example also be used for cigarillos which at one end are provided with a lighting part F. It is also possible to arrange the battery C in a different position, for example, next to a narrow side of the packet.

I claim:

1. A cigarette packet assembly including a packet having an open end and a closed end, a plurality of cigarettes and an electric lighter, which assembly comprises:

(a) an electric lighter including an electric battery and a pair of electrical contacts associated with each cigarette, each pair of contacts being connected to the positive and negative poles of the battery;

(b) a lighting part carried at the end of each cigarette adjacent the closed end of the packet when the cigarette is in a stored position, each lighting part being disposable in conductive relationship with a corresponding pair of contacts;

(c) each pair of contacts including a first contact disposed in continuous conductive relationship with the lighting part and a second contact disposed out of conductive relationship with the lighting part when the cigarette is in its stored position;

(d) the second contact extending towards the open end of the packet and disposable in conductive relationship with the lighting part when the cigarette is being pulled out of the packet through the open end, thereby closing the electric circuit of the battery and heating the lighting part to a temperature sufficient to light the cigarette; and (e) the first contact being disengageable from the lighting part for opening the electric circuit of the battery after the cigarette has moved through a predetermined distance from the stored position.

2. The assembly of claim 1 wherein each lighting part includes a ring encircling its corresponding cigarette.

3. The assembly of claim 2 wherein each cigarette includes a sheath having a reinforced portion on which the ring is disposed.

4. The assembly of claim 2 wherein the ring is made of metal.

5. The assembly of claim 2 wherein the first contact is defined by a spring.

6. The assembly of claim 5 wherein the spring is made of metal.

7. The assembly of claim 1 wherein each lighting part is defined by a wire coil surrounding its respective cigarette.

8. The assembly of claim 7 wherein each cigarette includes a sheath having a reinforced portion on which the wire coil is disposed.

9. The assembly of claim 7 wherein the wire coil is made of metal.

10. The assembly of claim 7 wherein the first contact is defined by a spring.

11. The assembly of claim 10 wherein the wire coil and the spring are integrally formed as a single part.

12. The assembly of claim 10 wherein the spring is made of metal.

13. The assembly of claim 1 wherein each lighting part is defined by a clasp disposed axially on its respective cigarette.

14. The assembly of claim 13 wherein each cigarette includes a sheath having a reinforced portion on which the clasp is disposed.

15. The assembly of claim 13 wherein the clasp is made of metal.

16. The assembly of claim 13 wherein the first contact is defined by a spring.

17. The assembly of claim 16 wherein the spring is made of metal.

18. The assembly of claim 1 wherein each lighting part is defined by an annular coating around its respective cigarette.

19. The assembly of claim 18 wherein each cigarette includes a sheath having a reinforced portion on which the coating is disposed.

20. The assembly of claim 18 wherein the coating contains a member selected from the group consisting of a metal, graphite powder or mixture thereof.

21. The assembly of claim 18 wherein the first contact extends from the closed end towards the open end of the packet so that the coating slides along the first contact when the cigarette is being pulled out of the packet.

22. The assembly of claim 21 wherein the first contact is defined by a foil made of electrically conductive material.

23. The assembly of claim 22 wherein the foil is corrugated for facilitating the contact thereby with the coatings of the cigarettes and securing the cigarettes within the packet in their stored positions.

24. The assembly of claim 22 wherein the foil is made of metal.

25. The assembly of claim 1 wherein the second contact is formed by a foil made of electrically conductive material.

26. The assembly of claim 25 wherein the foil is corrugated for facilitating the contact thereby with the lighting parts of the cigarettes and securing the cigarettes within the packet in their stored positions.

27. The assembly of claim 25 wherein the foil is made of metal.

28. The assembly of claim 1 further including an insulating foil disposed adjacent the closed end of the packet for separating the second contact from the lighting part when the cigarette is in its stored position.

29. The assembly of claim 1 further including insulating foils for separating the lighting parts from each other when the cigarettes are disposed in their stored position.

30. The assembly of claim 1 wherein the battery is of a flat configuration and disposed at the closed end of the packet.

31. The assembly of claim 1 further including a switch for closing the electric circuit of the battery when the cigarette is pulled out of the packet through the open end.

* * * * *